US009490564B2

(12) United States Patent
Nakayama et al.

(10) Patent No.: US 9,490,564 B2
(45) Date of Patent: Nov. 8, 2016

(54) STRUCTURE FOR PROVISIONAL LOCKING OF TERMINAL OF CONNECTOR

(75) Inventors: Kouichi Nakayama, Makinohara (JP); Tsuyoshi Mizushima, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/006,466

(22) PCT Filed: Mar. 21, 2012

(86) PCT No.: PCT/JP2012/001913
§ 371 (c)(1),
(2), (4) Date: Sep. 20, 2013

(87) PCT Pub. No.: WO2012/127853
PCT Pub. Date: Sep. 27, 2012

(65) Prior Publication Data

US 2014/0011408 A1 Jan. 9, 2014

(30) Foreign Application Priority Data

Mar. 22, 2011 (JP) ..... 2011-061994

(51) Int. Cl.
*H01R 13/41* (2006.01)
*H01R 13/40* (2006.01)
(Continued)

(52) U.S. Cl.
CPC ..... *H01R 13/405* (2013.01); *H01R 13/41* (2013.01); *H01R 43/20* (2013.01); *H01R 11/12* (2013.01); *H01R 13/04* (2013.01); *H01R 2105/00* (2013.01)

(58) Field of Classification Search
CPC .... H01R 13/41; H01R 12/71; H01R 12/712; H01R 12/714; H01R 12/716; H01R 12/718; H01R 12/585
USPC ..... 439/733.1, 603, 869, 595
See application file for complete search history.

(56) References Cited

U.S. PATENT DOCUMENTS 5,879,200 A * 3/1999 Sugie ..... 439/733.1
7,059,918 B2 6/2006 Matsumoto et al.
(Continued)

FOREIGN PATENT DOCUMENTS

EP 1950841 A2 7/2008
EP 2073317 A1 6/2009
(Continued)

OTHER PUBLICATIONS

International Search Report and Written Opinion dated Jun. 15, 2012, issued for PCT/JP2012/001913.
(Continued)

*Primary Examiner* — Amy Cohen Johnson
*Assistant Examiner* — Matthew T Dzierzynski
(74) *Attorney, Agent, or Firm* — Locke Lord LLP

(57) ABSTRACT

A bevel portion extends from a front end of a plate-like electrical contact of the terminals to a lengthwise intermediate portion of the electrical contact, the bevel portion residing at an intersection of a width surface of the electrical contact with a thickness surface of the electrical contact. A step portion resides at an end of the bevel portion at the lengthwise intermediate portion of the electrical contact, the thickness surface extending in the thickness direction having one portion with reduced width defined by the bevel portion in the thickness direction. The other portion of the thickness surface continuing to an end of the step portion has an increased width in the thickness direction to define a press-fit portion. The electrical contact is inserted in a hole of a housing to the extent defined by the step portion and thereby provisionally locked with the press-fit portion press-fitted in the hole.

3 Claims, 3 Drawing Sheets

(51) Int. Cl.

| | |
|---|---|
| ***H01R 13/422*** | (2006.01) |
| ***H01R 13/405*** | (2006.01) |
| ***H01R 43/20*** | (2006.01) |
| *H01R 13/10* | (2006.01) |
| *H01R 13/193* | (2006.01) |
| *H01R 13/20* | (2006.01) |
| *H01R 13/26* | (2006.01) |
| *H01R 11/12* | (2006.01) |
| *H01R 13/04* | (2006.01) |
| *H01R 105/00* | (2006.01) |

(56) References Cited

U.S. PATENT DOCUMENTS

| | | | | |
|---|---|---|---|---|
| 8,092,262 | B1 * | 1/2012 | Frederick et al. | 439/751 |
| 8,672,700 | B2 * | 3/2014 | Matsumoto et al. | 439/364 |
| 8,672,706 | B2 * | 3/2014 | Matsumoto et al. | 439/489 |
| 2007/0054547 | A1 * | 3/2007 | Ohtaka et al. | 439/507 |
| 2007/0155255 | A1 * | 7/2007 | Galauner et al. | 439/891 |
| 2011/0201237 | A1 * | 8/2011 | Suzuki et al. | 439/884 |
| 2014/0342619 | A1 * | 11/2014 | Uchida | 439/751 |

FOREIGN PATENT DOCUMENTS

| | | | |
|---|---|---|---|
| JP | 2004-349026 | A | 12/2004 |
| JP | 2008181729 | A | 8/2008 |

OTHER PUBLICATIONS

Office Action mailed on Nov. 18, 2014 issued for corresponding Japanese Patent Application No. 2011-061994.

* cited by examiner

STRUCTURE FOR PROVISIONAL LOCKING OF TERMINAL OF CONNECTOR

TECHNICAL FIELD

The present invention relates to a terminal provisional locking structure of a connector in which a terminal is placed in a state of provisional locking prior to being secured to the housing by press-fitting.

BACKGROUND ART

It is advocated in the art to use a connector (not shown) for electrical connection of a motor to an inverter in a conventional electrically powered vehicle such as hybrid automobile as described in the patent literature PTL 1.

The connector comprises a substantially L-shaped connector housing made of insulating resin with three juxtaposed openings for each accommodating a terminal therein, the openings being provided on a back surface of the connector housing; three substantially L-shaped terminals adapted to be inserted in the corresponding one of the terminal accommodating openings and thereby into the connector housing; electrical wires each connected to corresponding one of the three terminals; and holders made of insulating resin with a boss portion adapted to press the terminals inward of the connector housing.

An electrical contact at an edge of each of the terminals is inserted into a slit-like hole provided in the connector housing. Terminals (which may comprise busbars) of a mating connector are secured by means of bolts to a corresponding circular hole provided at an edge of the electrical contact drawn out of it.

CITATION LIST

Patent Literature

[PTL 1]
Japanese Patent Application Laid-Open Publication No. 2004-349026

SUMMARY OF INVENTION

Technical Problem

In the case of the above state of the art connector, the terminal is pressed and retained by the holder with the terminal inserted in the connector housing. For example, when a holder for retaining the terminal is not used, as in the case of the connector 41 in FIG. 6, both ends 31*b* to 33*b* of the circular-arc-shaped edges 31*a* to 33*a* of the terminals 31 to 33 are placed in a state of provisional locking in a press-fitting manner with a narrow-width opening edge 43*a* of a hole 43 of a housing 42 made of insulating resin. In this state, the terminals 31 to 33 are further pressed by a not-shown pressing tool (which may comprise a pressing machine) to be placed in a state of complete locking in the hole 43.

As shown in FIG. 7, simultaneously with the complete press-fitting, for example, central front and rear projections 13, 15 widthwise of the central terminal 32, and a front-side projection 15 of right and left terminals 31, 33 are brought into locking engagement with a protruding wall 18*b* of the housing 42, and the terminals 31 to 33 are each kept in position and protected against inadvertent detachment therefrom. The provisional locking is a technique for, for example, not allowing the terminals 31 to 33 with the multiple (three in the figure) electrical wires to be detached from the housing 42 during the process until they are brought into the state of complete press-fitting (complete locking).

Meanwhile, in the case of the connector 41 shown in FIG. 6, there may be differences in the positions of provisional licking of the terminals 31 to 33. When they are pressed by a pressing machine, elongated straight portions (press-fit portions) 31*c* to 33*c* continuing to the circular-arc edges 31*a* to 33*a* are slid on the hole 43 of the housing 42, which causes roughening of the inner surfaces of the holes hole 43 and a state of incomplete insertion where the terminals 31 to 33 remain incompletely inserted due to the large sliding resistance, making it difficult to reliably perform connection (coupling) by means of bolts to a mating busbar.

Further, in a case where the press-fitting structure is eliminated in the provisional locking of the terminals 31 to 33 and, for example, there are provided not-shown provisional locking projections at both ends widthwise of the terminals 31 to 33, the housing 42 needs to include an escape portion such as a groove for allowing the provisional locking projection to escape to a predetermined insertion stroke position (prevent interference). This implies that the terminals 31 to 33 become larger in size in its width direction and the structure of the housing 42 becomes complicated and less cost-effective.

In view of the above identified drawbacks, an object of the present invention is to provide a terminal provisional locking structure in a connector that can place the terminals in a provisional locking state with respect to the housing with simple structure and smooth and reliable operation, and without positional displacement, and further perform press-fitting of the terminal into the housing smoothly and reliably.

Solution to Problem

In order to attain the above objective, a first aspect of the invention provides a terminal provisional locking structure in a connector comprising: a bevel portion extending from a front end of a plate-like electrical contact of a terminal to an intermediate portion of the electrical contact along a length of the electrical contact, the bevel portion being provided at an intersection of a widthwise surface of the electrical contact with a thickness surface of the electrical contact, one portion of the thickness surface having a reduced width along a thickness of the electrical contact, the reduced width being defined by presence of the bevel portion; a step portion provided at an end of the bevel portion at the intermediate portion of the electrical contact; and a press-fit portion defined by an other portion of the thickness surface continuing via the step portion to the one portion of the thickness surface, the press-fit portion having an increased width along the thickness of the electrical contact relative to the reduced width of the one portion of the thickness surface, the press-fit portion being adapted to be press-fitted in a hole of a housing so as to place the electrical contact in a state of provisional locking in which the electrical contact is inserted in the hole of the housing to an extent defined by presence of the step portion.

In accordance with the above-described configuration, the thickness surface extending in the thickness direction of the first portion of the terminal's electrical contact has the reduced width by the presence of the bevel portion. Accordingly, the first portion of the electrical contact is inserted smoothly in the hole of the housing with low frictional resistance, and the insertion of the electrical contact is stopped with a large frictional force at the time of starting the press-fitting of the step portion in to the hole (i.e., wide-width thickness surface, i.e., the front end of the press-fit portion of the second portion of the electrical contact begins to be press-fitted in the hole), and thereby the terminal is allowed to be placed in the state of provisional locking in the housing without positional deviation in the front-and-back direction. Following this, the terminal is strongly pressed in the direction of insertion by a press-fitting tool, and the press-fit portion of the second portion of the electrical contact is press-fitted in the hole. Since the press-fit portion has a length half the length of the entire electrical contact, press-fitting is readily and reliably carried out.

In accordance with a second aspect of the invention, in the context of the terminal provisional locking structure of a connector according to first aspect, a tapered-beveled portion is provided at a front end of the electrical contact, the bevel portion continuing to the tapered-beveled portion in one piece therewith.

In accordance with the above-described configuration, The front end portion of the electrical contact is first inserted into the hole of the housing via the tapered-beveled portion thereof smoothly without being caught by the hole, and then the both sides of the electrical contact continuing to the front end portion of the electrical contact in the width direction both sides are smoothly inserted with low friction via the bevel portion continuing to the tapered-beveled portion. The tapered-beveled portion at the front end and the bevel portion continuing thereto can be made simultaneously by press working.

In accordance with a third aspect of the invention, in the context of the terminal provisional locking structure of the connector according to the first or second aspect thereof, the bevel portion comprises an upper bevel portion, a lower bevel portion, a right bevel portion, and a left bevel portion provided at the intersection of the electrical contact and the step portion comprises an upper step portion, a lower step portion, a right step portion, and a left step portion provided at the intersection of the electrical contact.

In accordance with the above-described configuration, the thickness surface extending in the thickness direction of the electrical contact has the reduced width by the presence of the upper, lower, right, and left bevel portions at the centre of the electrical contact in the thickness surface extending in the thickness direction, which further facilitates smooth insertion of the first portion of the electrical contact into the hole. Further, by virtue of the upper, lower, right, and left step portions, the electrical contact is allowed to be further reliably placed in the state of provisional locking without positional deviation. Still further, the upper, lower, right, and left step portions allow the press-fit portion of the second portion of the electrical contact is press-fitted further smoothly and reliably in the hole of the housing with a uniform force without occurrence of bending force in the upper and lower direction.

Advantageous Effects of Invention

The invention according to the first aspect thereof has the following advantageous effects: The terminal's electrical contact is smoothly inserted into the hole of the housing until to the extent defined by the presence of the step portion at the lengthwise intermediate portion of the electrical contact with small force, and by virtue of the step portion, positional deviation (variation in positions) is prevented in the front-and-back direction so that the electrical contact is placed reliably in the state of provisional locking. Also, since the both sides of the electrical contact, i.e., the thickness surface extending in the thickness direction, does not include a provisional locking projection, it is made possible to prevent increase in the dimension, of the terminal in its width direction and structural complexity when compared with a case where the provisional locking projection is provided. Further, an escape portion does not need to be provided in the housing corresponding to the provisional locking projection, so that the structure of the housing can be simplified. Still further, when compared with a case where the provisional locking portion is provided in the front end of the terminal, the length of the press-fit portion from the step portion and rearward is reduced to almost half that of the above-mentioned case. Accordingly, it is made possible to press-fit the electrical portion into the hole smoothly in a short period of time, without shortage or excess in the degree of press-fitting and achieve full and complete reliable press-fitting, so that the connection to the mating terminal can be performed reliably.

The invention according to the second aspect thereof has the following advantageous effects: The terminal's electrical, contact can be smoothly inserted into the hole from the front end to the step portion provided at the lengthwise intermediate region via the tapered-beveled portion and the bevel portion without being caught on the hole. Also, the tapered-beveled portion at the front end and the bevel portion continuing thereto can be made simultaneously by press working.

The invention according to the third aspect thereof has the following advantageous effects: The provisional locking of the terminal's electrical contact into the hole of the housing can be performed reliably by virtue of the upper, lower, right, and left step portions without positional deviation. Also, the press-fit portion continuing to the upper, lower, right, and left step portions ensures further reliable press-fit into the hole without oscillation insertion into the hole.

DESCRIPTION OF EMBODIMENTS

FIGS. 1 to 5 depict a structure for provisional locking of a terminal of a connector according to one embodiment of the present invention.

Figure 1:
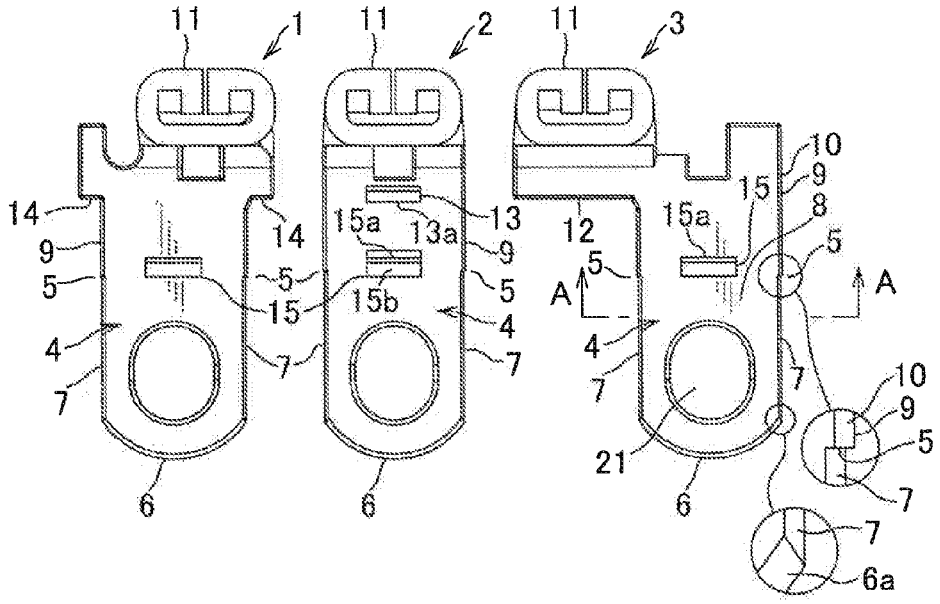
FIG. 1 is a plan view illustrating a terminal provisional locking structure in a connector according to one embodiment of the present invention.

Referring to FIG. 1 (which shows a plan view), there are shown three terminals 1 to 3 juxtaposedly arranged in a width direction. The terminals 1 to 3 each include a horizontal plate-like electrical contact 4. The electrical contact 4 includes step portions 5 at both sides in the width direction of the electrical contact 4, a circular-arc edge portion 6, and wide-width bevel portions 7. The step portions 5 are each formed at the intermediate portion of the electrical contact 4 in the length direction thereof (to put it another way, substantially at the central portion of the electrical contact 4). The wide-width bevel portion 7 extends from the step portion 5 (also referred to as "step surface") to the circular-arc edge portion 6. The bevel portion 7 takes a cross-sectionally tapered shape with beveled configuration at both sides, and the bevel portion 7 also continuing to a tapered-beveled portion 6*a* of the circular-arc edge portion 6.

Figure 2:
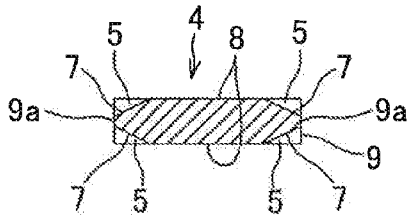
FIG. 2 is a cross-sectional view of a terminal in a provisional locking portion taken along the line A-A in FIG. 1

Referring to FIG. 2 (which shows a cross-sectional view taken along the line A-A in FIG. 1), the step portion (step surface) 5 and the bevel portion 7 are arranged in the upper and lower regions of the electrical contact 4, the orientation of upper and lower being defined with reference to the thickness of the electrical contact 4. One of the electrical contacts 4 includes four (i.e., upper, lower, right, and left) step portions 5 (step surfaces) and four bevel portions 7. The bevel portions 7 each extend from the tip (front end) of the electrical contact 4 toward the intermediate portion along the length of the electrical contact 4. The bevel portions 7 are provided at the intersection of (a) the upper and lower (front and back) surfaces 8 in the width direction of the electrical contact 4 with (b) the side surface 9 (surface) electrical contact 4 extending in the thickness direction thereof. The step portion 5 is provided (i) at the end of the bevel portion 7 of the electrical contact 4 and (ii) at the intermediate portion of the electrical contact 4 along the length thereof.

The upper, lower, right, and left bevel portions 7 each have tapered sloping surfaces (which is also indicated by the reference sign 7) at both sides, the tapered sloping surfaces 7 extending from upper and lower horizontal surfaces 8 of the electrical contact 4 (the surfaces 8 being parallel to each other) and sloping from the both sides toward the centre of the electrical contact 4 along the thickness thereof. The vertical step surface 5 is orthogonal to the end of the sloping surface 7, so that the step surfaces 5 take a triangular shape from an anterior view. The upper and lower sloping surfaces 7 continues to each other via a narrow-width vertical side surface 9*a* (surface) at the centre in the thickness direction of the electrical contact 4. The step surface 5 (step portion) is defined by the bevel portion 7 formed at the side of the electrical contact 4. It is also contemplated that the narrow-width side surface 9*a* may be eliminated such that the upper and lower sloping surfaces 7 take a V-shape.

The bevel portion 7 can be readily formed by strongly pressing (or compressing) the upper and lower edges of the sides of the electrical contact 4 by upper and lower sloping surfaces of a not-shown press-working die. Since the electrical contact 4 has a landscape-long rectangular shape, the step surfaces 5 at four corners of the cross-section of the electrical contact 4 with the longer side of the step surfaces defined in its front elevation by the sloping surface 7 so s to generally take a shape of a right triangle. The upper left and right sloping surfaces 7 in FIG. 2 continue to the upper tapered-beveled portion 6*a* of the circular-arc edge portion 6 in FIG. 1, and the lower left and right sloping surfaces 7 in FIG. 2 continues to a not-shown lower tapered-beveled portion (6*a*) of the circular-arc edge portion 6 in FIG. 1.

In the example of FIG. 1, there is provided a small tapered-beveled portion 10 rearward of the step portion 5, the tapered-beveled portions being provided at both sides of the electrical contact 4. Accordingly, in a strict sense, the step surface 5 in FIG. 2 is formed not in a triangular shape but in a trapezoidal shape, so that the narrow-width sloping surface (tapered-beveled portion) 10 is positioned obliquely upward of the wide-width sloping surface 7 substantially in parallel to the sloping surface 7. When the small tapered-beveled portion 10 is not provided, then the step surface 5 will take the triangular shape. In any case, the side surface 9 continuing to a rear portion of the step portion 5 will become the wide-width press-fit portion 9 which is wide in the thickness direction.

Still referring to FIG. 1, the terminals 1 to 3 includes a vertical wire connecting portion 11 (also referred to as "press-fit portion") upstanding upward from the electrical contact 4. The terminals 1 to 3 are each formed generally in an L-shape when view from its side surface through being defined by the horizontal electrical contact 4 and the vertical wire connecting portion 11. In this embodiment, the electrical contact 4 of the right terminal 3 is considerably rightward eccentric with reference to the wire connecting portion 11. The left electrical contact 4 of the terminal 1 is moderately leftward eccentric with reference to the wire connecting portion 11. The electrical contact 4 of the central terminal 2 is arranged without eccentricity to the wire connecting portion 11. The wire connecting portions 11 are arranged at the same pitches in the left-to-right direction and without displacement in the front-to-rear direction.

Figure 7:
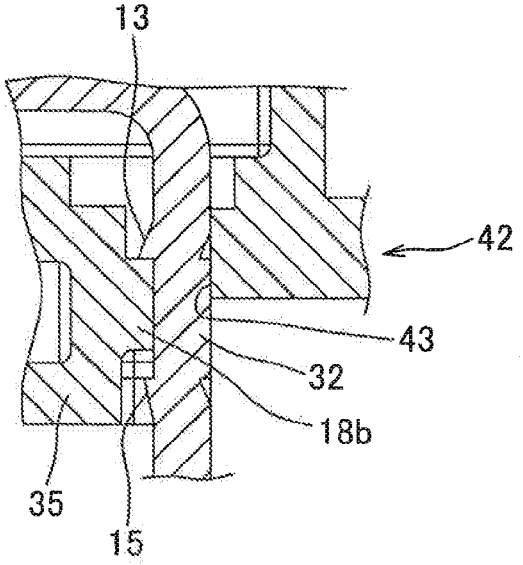
FIG. 7 is a vertical cross-sectional view illustrating a principal part of a terminal in a state of complete locking.

The right terminal 3 includes an elongated abutting plate 12 protruding from the rear end of the electrical contact 4. The left terminal 1 includes a short abutting plate 14 protruding from the right and left of the rear end of the electrical contact 4. The central terminal 2 includes an upward projection 13 (also referred to as "abutment portion") at a region near the rear end of the electrical contact 4. The projection 13 includes a vertical abutting surface 13*a* at its front end. The electrical contacts 4 each include a projection 15 provided rearward of the hole 21, which is a hole provided at a region near the end of the of the electrical contact 4 and adapted for insertion of a bolt. The projections 15 each include a vertical locking surface 15*a* at the rear side, and a sloping surface 15*b* at the front side. The projections 13, 15 have the same configuration illustrated in FIG. 7. A step portion 5 is provided at both sides (right and left sides) of the front end of the front-side projections 15. It should be noted that this specification uses terms indicating orientation such as upper, lower, front, and rear for the sake of explanation only. Such terminology does not necessarily coincide with the actual direction in which the connector 16 is mounted (see FIG. 4).

Figure 3:
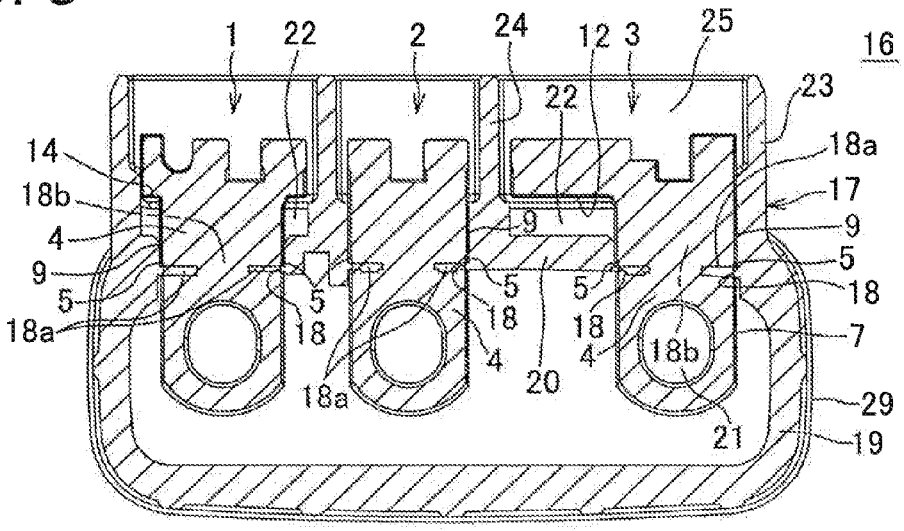
FIG. 3 is a transverse cross-sectional view of the terminal placed in a state of provisional locking with a housing.

As shown in FIG. 3 (which shows a transverse cross-sectional view), the electrical contacts 4 of the terminals 1 to 3 are halfway inserted in the holes 18 that are provided in the horizontal direction of the insulating-resin housing 17, respectively, i.e., until they reach the step portion 5 in a slight press-fitting manner to be brought into the state of provisional locking. The provisional locking is done with such a frictional resistance that the narrow-width side surface 9*a* (see FIG. 2) between the upper and lower step portions 5 is brought into contact with the side surface (also indicated by the same reference sign 18) of the hole 18.

The state of provisional locking is completely entered immediately before the second portion (press-fit portion 9) of the electrical contact 4 in the landscape-long rectangular shape (where the bevel portion 7 is not provided) continuing to the step portion 5 begins to be press-fitted in the hole 18. The first portion of the electrical contact 4 slid on the side surface of the hole 18 with low frictional force with the narrow-width side surface 9*a* (see FIG. 2) that is contracted by the upper, lower, right, and left bevel portions 7, and thus inserted smoothly into the hole 18 with small force.

When the narrow-width side surface 9*a* is eliminated and the upper and lower sloping surfaces 7 continues to each other in a V-shaped manner, then the tip of the side is brought into contact with the inner surface of the hole 18 in a linear manner and slid thereon with further smaller frictional resistance. It is contemplated that the configuration of "the surface 9 in the thickness direction is widthwise narrowed in the thickness direction by the bevel portion 7" recited in the appended claims includes this "V-shape."

The step surface 5 is brought into contact with the rear end of the hole 18 in a somewhat trapped manner so that the sliding frictional resistance is increased, and insertion of the electrical contact 4 beyond that extent is prevented. By virtue of the step portion 5, the provisional locking position of the terminals 1 to 3 are accurately defined. Since it is inserted into the hole 18 to such an extent that it reaches an intermediate portion in the length direction (i.e., to the position corresponding to the half the length of the electrical contact 4), it is made possible to exploit the provisional locking force with small frictional resistance and thereby prevent the detachment of the terminals 1 to 3 having the electrical wires from the housing 17.

As shown in FIG. 3, the landscape-long rectangular shape (slit-like) holes 18 adapted for insertion of terminals are provided in the rear wall 20 of the landscape-long generally-rectangular-cylindrical-shaped accommodating portion (surrounding wall) 19 of the housing 17 (the wall portion around the hole 18 is indicated by the reference sign 18*a*), and is in proximity of or in contact with the rear end of the wall portion 18*a* so that the step portion 5 of the terminals 1 to 3 in the provisionally-locked state is placed in position. The wall portion 18*b* is provided between the left and right wall portions 18*a*, the wall portion 18*b* being adapted for passing the front-side projection 15 of the terminals 1 to 3 therethrough.

The abutment portions 12 to 14 at the rear end of the terminals 1 to 3 are arranged rearward of the rear wall 20 of the accommodating portion 19 of the housing 17 with a large gap 22. FIG. 3 does not illustrate the wire connecting portion 4 of the terminals 1 to 3. The holes 18 are in communication with the accommodating spaces (space) 25 defined by a partition wall 24 in the accommodating portion 23 in the second portion of the housing 17, and the wire connecting portion 11 (see FIG. 1) of the terminals 1 to 3 are each accommodated in the accommodating space 25.

The electrical contact 4 of the terminals 1 to 3 in FIG. 3 is taken out of the provisionally-locked state using a not-shown press-fitting and in turn pressed frontward with large force, so that the press-fit portion 9 straight and wide in the thickness direction from the step portion 5 of the terminals 1 to 3 to the rear portion is press-fitted along the inner surface of the upper, lower, right, and left wall portion 18*a* for press-fitting of the hole 18. At the same time, the front-side projection 15 of the terminals 1 to 3 (FIG. 1) goes beyond the upper inner wall 18*b* of the hole 18, and the rear-side abutment portions 12 to 14 of the terminals 1 to 3 are brought into abutment against the rear surface of the rear wall 20 of the accommodating portion 19 of the housing 17, so that any additional press-fitting of the terminals 1 to 3 is prevented.

The press-fit portion 9 that is straight and wide in the thickness direction and continues from the provisional locking portion (step portion) 5 of the terminal 1 to 3 to the rear portion has a length half that of the straight press-fit portions 31*c* to 33*c* continuing from the provisional locking portion (the both, or right and left, sides portions of the circular-arc front end portion) 31*b* to 33*b* of a conventional terminals 31 to 33 (FIG. 7) to the rear portion, the length being defined in the press-fitting direction (i.e., the press-fit stroke is shorter), which facilitates press-fitting operation, the time required for press-fitting is shortened, and incomplete press-fitting is eliminated, and the terminals 1 to 3 are fully and reliably press-fitted, and further inconveniences such as the press-fit portion 9 excessively wearing the inner surface of the hole 18 of the housing 17. By virtue of the terminals 1 to 3 fully and completely press-fitted with a predetermined stroke, and thus the screw-connection to the mating not-shown busbar can reliably take place without positional deviation.

Also, it is not necessary to provide an escape portion toward the provisional locking position in the housing 17, the escape portion being required when a not-shown projection for provisional locking is provided in the terminal 1 to 3. Accordingly, the structure of the housing 17 is simplified and the manufacturing cost thereof can be reduced. The reference sign 29 in FIG. 3 indicates a ring-shaped waterproofing packing.

Figure 4:
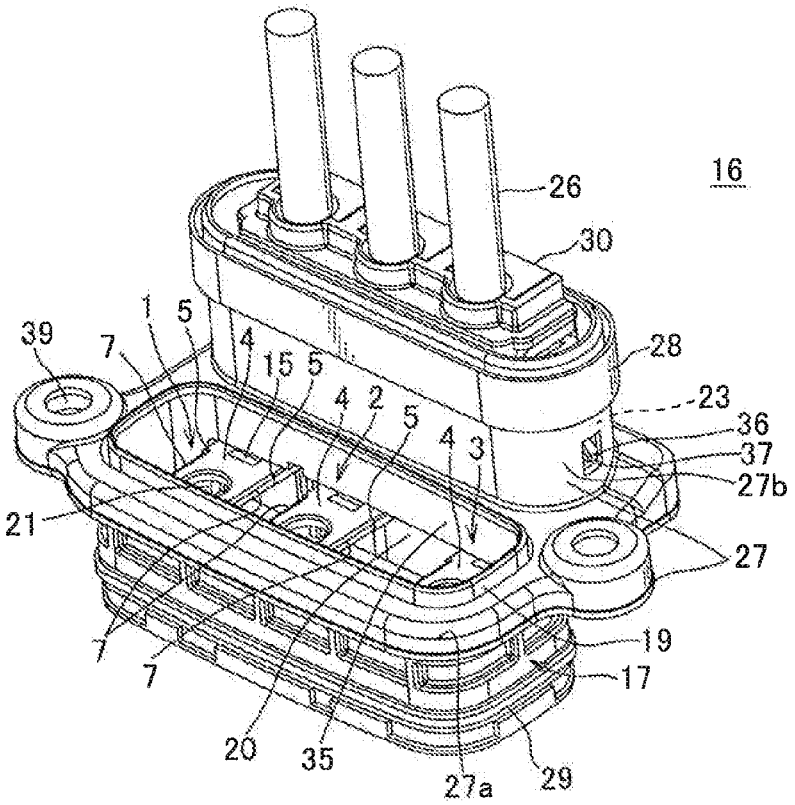
FIG. 4 is a perspective view of a connector in an assembled state where the terminal is placed in a state of complete locking (complete press-fitting) with the housing.

FIG. 4 illustrates a situation where, after the complete press-fitting of the terminals 1 to 3 with the electrical wires 26 with respect to the hole 18 of the housing 17 (FIG. 3) is completed, a shield shell 27 and a shield ring 28 made of conductive metal and a waterproofing packing 29 are attached to the outside of the housing 17, and the holder 30 made of synthetic resin is attached to the housing 17 at its side of drawing out the electrical wire. The term "complete press-fitting" is a term defined relative to the provisional press-fitting where the first portion of the electrical contact is inserted by a hand or fingers slightly in a press-fitting-like manner.

The housing 17 comprises a front-side accommodating portion (surrounding wall) 19 and a rear-side accommodating portion 23. The electrical contacts 4 of the terminals 1 to 3 are arranged protruded and aligned in the front-side accommodating portion 19, and a not-shown mating busbar of the component 34 (FIG. 5) is arranged in contact therewith below the bolt-insertion hole 21 of the electrical contact 4. The projections 15 of the electrical contacts 4 are arranged below the upper rear wall 35 of the accommodating portion 19. The wall portion 18*b* (FIG. 3) for locking engagement with the projection 15 is arranged slightly rearward of the upper wall portion 35 (see FIG. 7). The step portion 5 of the terminal 1 to 3 is positioned at both (right and left) sides of the projection 15, and the upper, lower, right, and left bevel portions 7 are positioned in front of the step portion 5.

The accommodating portion 19 in the first portion of the housing 17 is covered by the flange wall 27*a* of the shield shell 27, and the upward accommodating portion 23 in the second portion of the housing 17 is covered by the cylindrical wall 27*b* of the shield shell 27, so that the projections 36 at right and left sides of the accommodating portion 23 is brought into locking engagement with the hole 37 of the cylindrical wall 27*b*. The holder 30 has a front-and-rear two-part configuration in which the two parts are brought into locking engagement with each other such that the shield electrical wire 26 is sandwiched in a front-and-rear manner by the holder 30.

Figure 5:
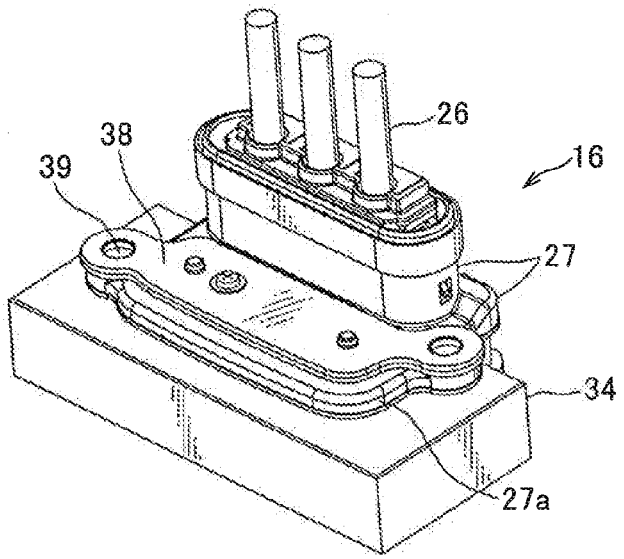
FIG. 5 is a perspective view of the connector attached and connected to a component.
Figure 6:
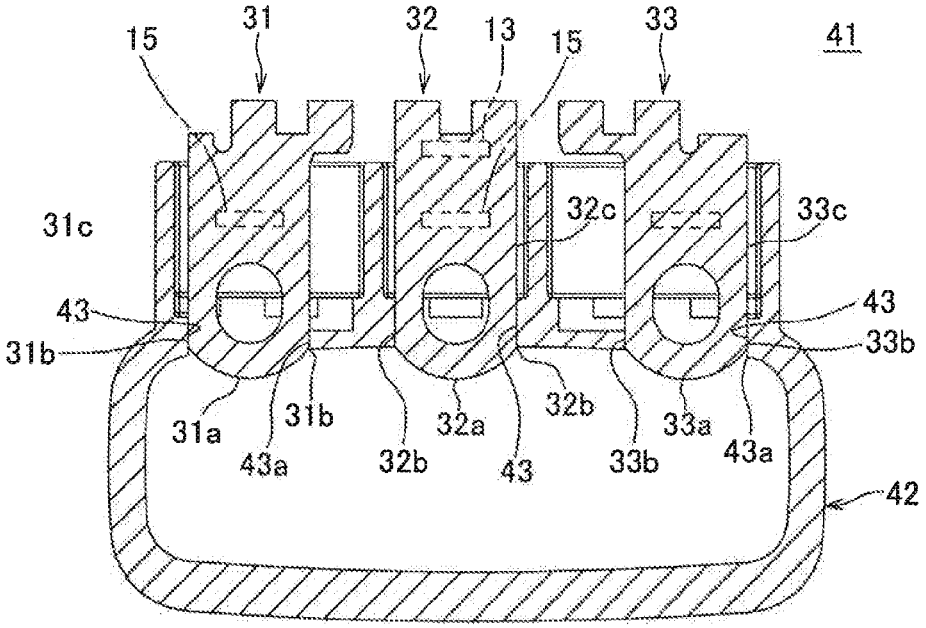
FIG. 6 PRIOR ART
FIG. 6 is a transverse cross-sectional view of a conventional terminal provisional locking structure in a connector in one embodiment thereof.

As shown in FIG. 5, the terminals 1 to 3 in FIG. 4 are connected by means of bolts to above to not-shown busbars (mating terminal) in the component 34 such as the motor and the inverter, and after that, the upper opening in the first portion accommodating portion 19 of the housing 17 (FIG. 4) is closed by a cover 38 made of conductive metal, and the cover 38 and the hole 39 of the flange wall 27*a* of the shield shell 27 are secured by means of bolts to a case (also indicated by the reference sign 34) made of conductive metal of the component 34. The packing 29 in FIG. 4 is placed in tight contact with the inner surface of the not-shown hole in the component 34. The connector 16 serves as a connector adapted for direct connection to a component.

In the above-described embodiment, the projection 15 for complete locking is provided in the terminals 1 to 3. However, it is also contemplated that the projection 15 is eliminated and the terminal 1 to 3 may be only secured by means of the press-fitting of the electrical contact 4 to the hole 18 of the housing 17. Also, in place of the edge portion 6 of the circular arc of the terminals 1 to 3, the edge portion (6) may take a trapezoidal shape and a rectangular shape (linear-shaped tip).

Also, the bevel portions 7 of the terminals 1 to 3 are not limited to four in number, i.e., upper, lower, right, and left, but may be provided two in number only at upper right and left portions or lower right and left portions. Even in this case, the end of the bevel portion 7 includes a step portion 5 for provisional locking, and by means of the bevel portion (sloping surface) 7, there is created a narrow-width surface (9*a*) for insertion along a thickness direction of the electrical contact 4.

Also, the first portion of the electrical contact 4 has a width slightly smaller than that of the second portion thereof, which allows the first portion is inserted not in a press-fitting-like manner but almost without sliding resistance (without frictional resistance between the side surface 9*a* of the first portion and the inner surface of the hole 18) into the hole 18 of the housing 17, and it is also contemplated that the step portion 5 at the end of the bevel portion 7 of the first portion, i.e., the front end of the second portion is slightly pressed into the hole 18 for press-fitting, so that the terminal 1 to 3 is allowed to be brought into provisional locking.

INDUSTRIAL APPLICABILITY

A terminal provisional locking structure of a connector of the present invention can be applicable to bring the three-phase electrodes in an electrically powered vehicle such as hybrid automobile into a state of provisional locking with an insulating housing smoothly and reliably so as to prevent detachment of terminal while being conveyed and bring the terminal in the subsequent process into a state of complete press-fitting to a housing smoothly and reliably.

REFERENCE SIGNS LIST

1-3 Terminal
4 Electrical contact
5 Step portion
6*a* Tapered-beveled portion
7 Bevel portion
8 Surface in the plate-width direction
9 Thickness surface extending in the thickness direction portion)
16 Connector
17 Housing
18 Hole

The invention claimed is:

1. A structure for provisional locking a terminal of a connector, comprising:

a bevel portion extending from a front end of a flat-shaped electrical contact of the terminal to an intermediate portion of the electrical contact along a length of the electrical contact, the bevel portion being provided at an intersection of a widthwise surface of the electrical contact with a thickness surface of the electrical contact, a provisional locking portion of the thickness surface having a reduced width, the reduced width being defined by presence of the bevel portion;

a step portion provided at an end of the bevel portion at the intermediate portion of the electrical contact; and a press-fit portion defined by another portion of the thickness surface starting from the step portion and continuing in a rearward direction of the provisional locking portion of the thickness surface, the press-fit portion being thicker than the reduced width of the provisional locking portion of the thickness surface, wherein the provisional locking portion is partitioned from the press-fit portion by the step portion that extends in a width direction of the electrical contact, the step portion being formed as a planar boundary surface between two distinct planes, wherein, the provisional locking portion is configured such that, when the electrical contact is inserted into a hole of a housing to a location where the step portion is provided, the thickness surfaces having the reduced width of the provisional locking portion on both widthwise sides of the electrical contact are contacted with side surfaces of the hole on both sides, respectively, thereby the provisional locking portion is provisionally locked to the hole by a frictional resistance, and wherein the press-fit portion is configured to be press-fitted into the hole after the provisional locking portion is provisionally locked to the hole.

2. The structure as set forth in claim 1, wherein a tapered-beveled portion is provided at a front end of the electrical contact, the bevel portion continuing to the tapered-beveled portion in one piece therewith.

3. The structure as set forth in claim 1, wherein the bevel portion comprises an upper bevel portion, a lower bevel portion, a right bevel portion, and a left bevel portion provided at the intersection of the electrical contact and the step portion comprises an upper step portion, a lower step portion, a right step portion, and a left step portion provided at the intersection of the electrical contact.

* * * * *